US011059641B2

(12) United States Patent
Peuker et al.

(10) Patent No.: US 11,059,641 B2
(45) Date of Patent: Jul. 13, 2021

(54) DISPENSER FOR A FLOWABLE SUBSTANCE

(71) Applicant: 3M INNOVATIVE PROPERTIES COMPANY, St. Paul, MN (US)

(72) Inventors: Marc Peuker, Schöndorf (DE); Andreas J. Boehm, Reichling (DE); Martin Preininger, Herrsching (DE)

(73) Assignee: 3M Innovative Properties Company, St. Paul, MN (US)

( * ) Notice: Subject to any disclaimer, the term of this patent is extended or adjusted under 35 U.S.C. 154(b) by 10 days.

(21) Appl. No.: 16/628,777

(22) PCT Filed: Jul. 3, 2018

(86) PCT No.: PCT/US2018/040679
§ 371 (c)(1),
(2) Date: Jan. 6, 2020

(87) PCT Pub. No.: WO2019/010154
PCT Pub. Date: Jan. 10, 2019

(65) Prior Publication Data

US 2020/0140164 A1 May 7, 2020

(30) Foreign Application Priority Data

Jul. 7, 2017 (EP) ..... 17180193
Jul. 10, 2017 (EP) ..... 17180444

(51) Int. Cl.
*A61C 19/00* (2006.01)
*B65D 55/08* (2006.01)
*B65D 47/08* (2006.01)

(52) U.S. Cl.
CPC ..... *B65D 55/0818* (2013.01); *B65D 47/0809* (2013.01); *B65D 2203/02* (2013.01); *B65D 2401/05* (2020.05)

(58) Field of Classification Search
CPC ..... B65D 2547/066; B65D 55/0818; B65D 47/0809; B65D 47/0847; B65D 2401/05; B65D 2203/02
(Continued)

(56) References Cited

U.S. PATENT DOCUMENTS 5,106,297 A * 4/1992 Discko, Jr. ..... A61C 19/005 206/564
5,547,091 A * 8/1996 Neveras ..... B65D 35/14 215/237
(Continued)

FOREIGN PATENT DOCUMENTS

EP 1140646 10/2001
WO WO 2011-056814 5/2011

OTHER PUBLICATIONS

International Search Report for PCT International Application No. PCT/US2018/040679, dated Sep. 27, 2018, 6 pages.

*Primary Examiner* — King M Chu

(57) ABSTRACT

A dispenser has a bottle (2) and a closure (3) for the bottle (2). The closure (3) has abase (4) forming a dispensing outlet (6) and a flip-cap for openably closing the dispensing outlet (6). The base (4) is attached on the bottle (2). The dispenser (1) further having a hinge (7) which interconnects the flip-cap and the base (4) for swiveling the flip-cap relative to the base (4) between a closed position, in which the flip-cap closes the outlet (6), and an open position in which the outlet (6) is open. The hinge (7) forms a swivel axis. The closure (3) forms a first end (18, 19) in a direction toward the flip-cap and a second end (18, 19) in a direction toward the base (4). The closure (3) in an area between the hinge-level plane and the second end (18, 19) forms an outer surface circumferentially around the longitudinal axis which is at
(Continued)

least partly provided by an outer surface of the base (4) and an outer surface of the flip-cap.

12 Claims, 5 Drawing Sheets

(58) Field of Classification Search
USPC ..... 215/343, 237; 222/212, 545; 220/260; 206/63.5
See application file for complete search history.

(56) References Cited

U.S. PATENT DOCUMENTS

| | | | | |
|---|---|---|---|---|
| 5,996,849 | A | 12/1999 | Bansal | |
| 2003/0047937 | A1 * | 3/2003 | Chaduc | G09F 3/0292 283/81 |

* cited by examiner

DISPENSER FOR A FLOWABLE SUBSTANCE

FIELD OF THE INVENTION

The invention relates to a dispenser for a flowable substance that has a bottle and a closure for the bottle. The closure has a base that forms a dispensing outlet and a flip-cap for openably closing the dispensing outlet. The dispenser further has a hinge which interconnects the flip-cap and the base for swiveling the flip-cap relative to the base between a closed position, in which the flip-cap closes the outlet, and an open position in which the outlet is open.

BACKGROUND ART

Dental materials are often provided in packages that are designed to facilitate preparation and/or application of the materials in a dentist's practice. Flowable dental materials are for example often provided in dropper bottles which allow the material to be dispensed in droplets so that a desired amount can be easily metered by a user.

For example WO 2011/056814 A1 discloses a dispenser that has a body with an outlet, and a closure for the outlet. The closure and the body are pivotally movable relative to each other between an open position in which the outlet is open and a closed position in which the closure closes the outlet. The closure and the body are adapted for locking engagement with each other in the closed position. The closure has a locking member for locking and unlocking the closure and the body in the closed position. A force applied on the locking member for unlocking urges the closure toward the open position.

Although existing dropper bottles are used and useful in dentistry there is still a need for a dispenser that is easy to use and which is relatively inexpensive.

SUMMARY OF THE INVENTION

The invention relates to a dispenser for a flowable substance. The dispenser extends along a longitudinal axis. The dispenser comprises a bottle and a closure for the bottle. The closure has a base that forms a dispensing outlet and a flip-cap for openably closing the dispensing outlet. The base is attachable on the bottle and preferably is attached on the bottle.

The dispenser further has a hinge which interconnects the flip-cap and the base for swiveling the flip-cap relative to the base between a closed position and an open position. In the closed position the flip-cap closes the outlet, whereas in the open position the outlet is open. The closed position and the open position are also further referred to as the open position of the dispenser herein. In the open position the flip-cap is preferably positioned outside the longitudinal axis. Thus the presence of the flip-cap does not affect the use of the dispenser for dispensing the substance.

The hinge forms a swivel axis. The hinge forms the swivel axis in a (virtual) hinge-level plane that is arranged transverse, in particular preferably perpendicular, to the longitudinal axis. The hinge-level plane has an axial position on longitudinal axis and is preferably located between a first end of the dispenser and an opposite second end of the dispenser. The first end of the dispenser may be formed by the flip-cap, and the second end of the dispenser may be formed by the bottle. With reference to the dispenser standing on a horizontal support, for example a desk, the first end of the dispenser may also be referred to as the top end of the dispenser and the second end of the dispenser may also be referred to as the bottom end of the dispenser.

Further the closure a first end in a direction toward the flip-cap and a(n) (opposite) second end in a direction toward the base. The first end of the closure thus preferably corresponds to the first end of the dispenser. It is noted that the ends of the other components of the dispenser can be referred to accordingly. This means a first end of the flip-cap corresponds to the first end of the closure, and second end of the flip-cap is formed opposite of the first end of the flip-cap. Further, the base has a first end in a direction of the first end of the dispenser and a second end opposite of the first end. The bottle has a first end opposite of the second end of the dispenser, and the second end of the dispenser corresponds to a second end of the bottle.

In an embodiment the closure, in an area between the hinge-level plane and the second end, forms an outer surface circumferentially around the longitudinal axis. The outer surface of the closure between the hinge-level plane and the second end of the closure is at least partly provided by an outer surface of the base and an outer surface of the flip-cap. In particular, outer surface of the closure between the hinge-level plane and the second end of the closure may be composed of at least a partial outer surface of the base and at least a partial outer surface of the flip-cap.

In the closed position a first label is attached on said outer closure surface (in particular the outer surface of the closure between the hinge-level plane and the second end of the closure). The first label covers at least a portion of the outer base surface and at least a portion of the outer flip-cap surface. Thereby the first label may retain the flip-cap against swiveling toward the open position. The first label may be circumferentially wrapped around the dispenser between the hinge and the second end of the closure, or between the hinge and the second end of the bottle or dispenser. The first label may thus extend between the hinge and the second end of the closure in a dimension parallel to the longitudinal axis. Further, the first label may extend circumferentially around the dispenser. Further, the first label may extend from an area between the hinge and the second end of the closure and beyond the second end of the closure toward the second end of the dispenser in a dimension parallel to the longitudinal axis. Again, such a first label may extend circumferentially around the dispenser. It is noted that the first label may circumferentially extend around the dispenser or partially circumferentially extend around the dispenser in any of the embodiments mentioned.

The invention is advantageous in that it enables wrapping the first label around the dispenser and thereby providing an additional retention of the flip-cap and the base against swiveling from the closed toward the open position. Thus unintentional opening of the dispenser is prevented by the first label (for example during transport and handling). Further, due to the configuration of the closure the hinge does not interfere with the first label wrapped around the dispenser and at the same time the base and the flip-cap can be retained via the first label with each other. Further, the invention allows the use of standard labelling equipment so that the costs can be minimized. In particular the first label can be wrapped around the dispenser without the need of accounting for any rotational position between the dispenser and the label. This means that the rotational position of the first label relative to the dispenser can be variable, for example there is no need to align a position of the first label to a circumferential position of the dispenser.

Preferably, the hinge is arranged between the first and second end of the flip-cap. This means that the flip-cap may extend from the hinge-level plane toward directions of the longitudinal axis.

The dispenser further preferably comprise the flowable substance. The flowable substance may be a liquid for example. A pasty substance of sufficiently low viscosity to be dispensed in droplets may likewise be used with the present invention. The flowable substance is preferably a dental substance, for example a dental bonding or a dental adhesive.

The bottle may be axially symmetric or generally axially symmetric with the longitudinal axis forming the axis of symmetry. For example the bottle may be a blow molded bottle. Further, the bottle may have an outer thread for attachment to a corresponding inner thread in the base. The bottle may further have a sealing rim for mating with a sealing receptacle in the base. The bottle may exhibit light blocking filter properties in a wavelength range of 450 nm to 495 nm and may be translucent to visible light at wavelengths outside the range of 450 nm to 495 nm. In this regard visible light has wavelength within a range of 380 nm to 750 nm. The term "light blocking filter properties" as referred to herein may correspond to a transmittance of less than 5% and the term "translucent" may correspond to a transmittance of more than 20%. The partial light blocking and partial translucent property of the bottle prevents the flowable substance from inadvertent hardening in case the flowable substance is a light hardenable (or photo curable) material that can be hardened by blue light (having a wavelength within 450 nm to 495 nm).

In one embodiment the flip-cap is formed by a cup-shaped shell. The cup-shaped shell may have a bottom wall and a circumferential side wall that extends from the bottom wall. The bottom wall further forms the first end of the flip-cap and the side wall forms the second end of the flip-cap.

In an embodiment the hinge is connected to the side wall of the flip-cap. Preferably, the hinge is formed adjacent the outer surface of the flip-cap.

In a further embodiment a first retention structure is provided in or at the side wall of the flip-cap for cooperation with a second retention structure provided on the base. The first retention structure may be a recess, in particular a blind-recess arranged on an inside of the side wall. Further, the second retention structure may be a bulge protruding from the base. The bulge may protrude from the base in a direction way from the longitudinal axis. Further, the bulge may correspond in shape to a negative shape of the recess. The first and second retention structure are positioned, shaped and sized so that they engage with each other in the closed position of the dispenser. Further, the first and second retention structure form a snap connection. This means that the flip-cap and the base can be swiveled from the closed toward the open position by overcoming the retention provided by the snap connection.

In a preferred embodiment the hinge forms a bistable hinge. Accordingly the hinge may be configured to urge the flip-cap toward either the closed or the open position and away from any intermediate position. The hinge is preferably particularly configured to urge the flip-cap in either a pre-closed or an open position. The pre-closed position is between the closed and the open position and closer to the closed position. In particular, in the pre-closed position the flip-cap covers the outlet without sealing the outlet. Further, in the pre-closed position the flip-cap and the remainder of the dispenser are visibly misaligned. For example, in case the dispenser has an overall cylindrical shape, any cylindrical section of the flip-cap is inclined with respect to the cylinder-shape of the remainder of the dispenser. In addition in the pre-closed position the flip-cap and the base are not snap connected. It has been found that a bistable hinge that positions the flip-cap to a pre-closed position (and not as in the prior art to the closed position) help to make sure that a user manually closes the dispenser tightly. A bistable hinge that attempts to urge the flip-cap in the closed position may in the opposite result in a situation in which the dispenser appears to be closed but in in fact is not. Accordingly, the positioning to a clearly visible pre-closed position helps ensuring a reliable reclosing by users.

In one embodiment the flip-cap and the base in combination form a parting line in the closed position of the dispenser. The parting line preferably extends at least in part offset from the hinge-level plane. The offset is in a direction from the hinge toward the second end of the closure. Further, the parting line preferably is formed by an edge of the flip-cap at the outer surface of the flip-cap in combination with an edge of the base at the outer surface of the base. The parting line may be defined on a (virtual) parting-level plane that is inclined with respect to the longitudinal axis. In another embodiment the parting line may be defined on a (virtual) parting-level plane that is parallel to the hinge-level plane but offset thereto.

In a further embodiment the first label extends at least partially circumferentially around the longitudinal axis. The first label preferably forms a pull-strap for facilitating the first label to be removed by a user. The pull-strap is preferably formed by only a portion of the label. Further, the pull-strap preferably is configured so that it does not adhere to the dispenser. In particular, the first label may be overall adhesive coated and on the portion forming the pull-strap the adhesive may be covered by a liner. Such a liner may exhibit non-sticky properties. Alternatively, the pull-strap may be formed by a portion of the overall adhesive coated first label, wherein the portion that forms the pull-strap is folded by 180 degrees with the adhesive coating attaching to each other. Further, the first label may only be adhesive coated on areas outside the portion forming the pull-strap and the portion forming the pull-strap may be free of adhesive.

In an embodiment the dispenser has a second label bonded on the bottle. The second label may exhibit information about the substance stored in the dispenser. The second label may be additionally or alternatively bonded to the base. This means that the second label may be bonded on the bottle and the base or on the base or the bottle only. Further, in addition or alternatively the first label may exhibit information about the substance stored in the dispenser. The first label may be bonded partially on the bottle, meaning may extend from the flip-cap over at least a portion of the base onto the bottle.

In an embodiment the first and second label are connected via a predetermined breaking zone or predetermined breaking line. The predetermined breaking zone or predetermined breaking line allows for the first label to be removed from the dispenser without removing the second label. Therefore the first and second label may in combination form a tamper-evident label. The tamper-evidence is provided by the predetermined breaking zone or predetermined breaking line being coherent or separated.

Preferably the closure, between the hinge-level plane and the second end of the closure, forms a cylindrical surface or a generally cylindrical surface. Further, the dispenser preferably has an overall cylindrical surface except for an activator portion formed by the flip-cap. The activator portion may be arranged opposite of the hinge and may comprise a protrusion in a direction transverse of and away from the longitudinal axis. Further, the activator portion may comprise a recess for a finger or a thumb. Thus, a user may push the flip-cap toward the open position by using a finger or thumb.

The closure may be made of a plastic material, preferably a thermoplastic polymer. Examples of a thermoplastic polymer comprise polypropylene (PP), polyethylene (PE), polyoxymethylene (POM) or polyamide (PA). Other thermoplastic polymers are possible as appropriate.

DETAILED DESCRIPTION OF THE INVENTION

Figure 1:
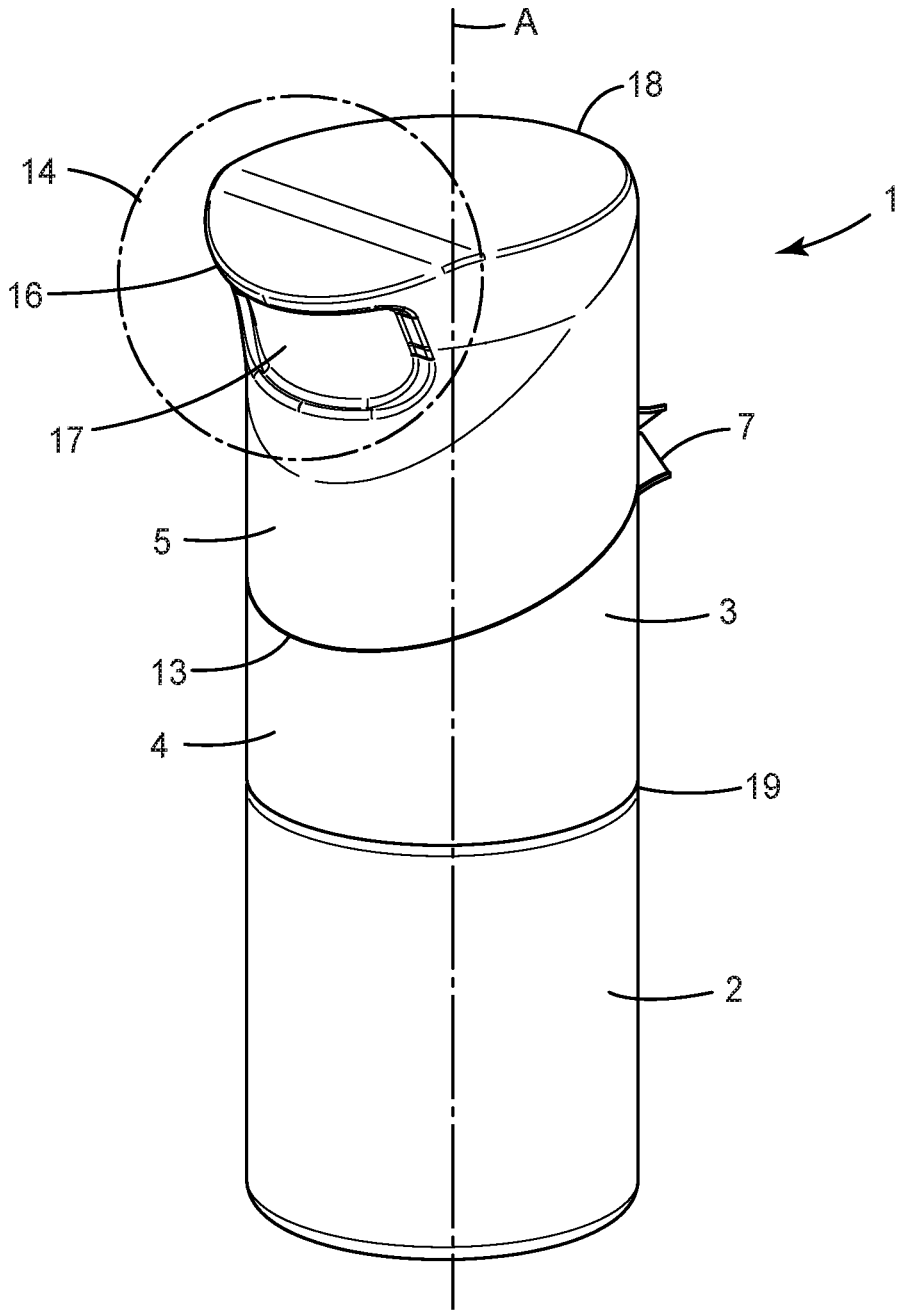
FIG. 1 is a perspective view of a dispenser according to an embodiment of the invention in a closed position.
Figure 2:
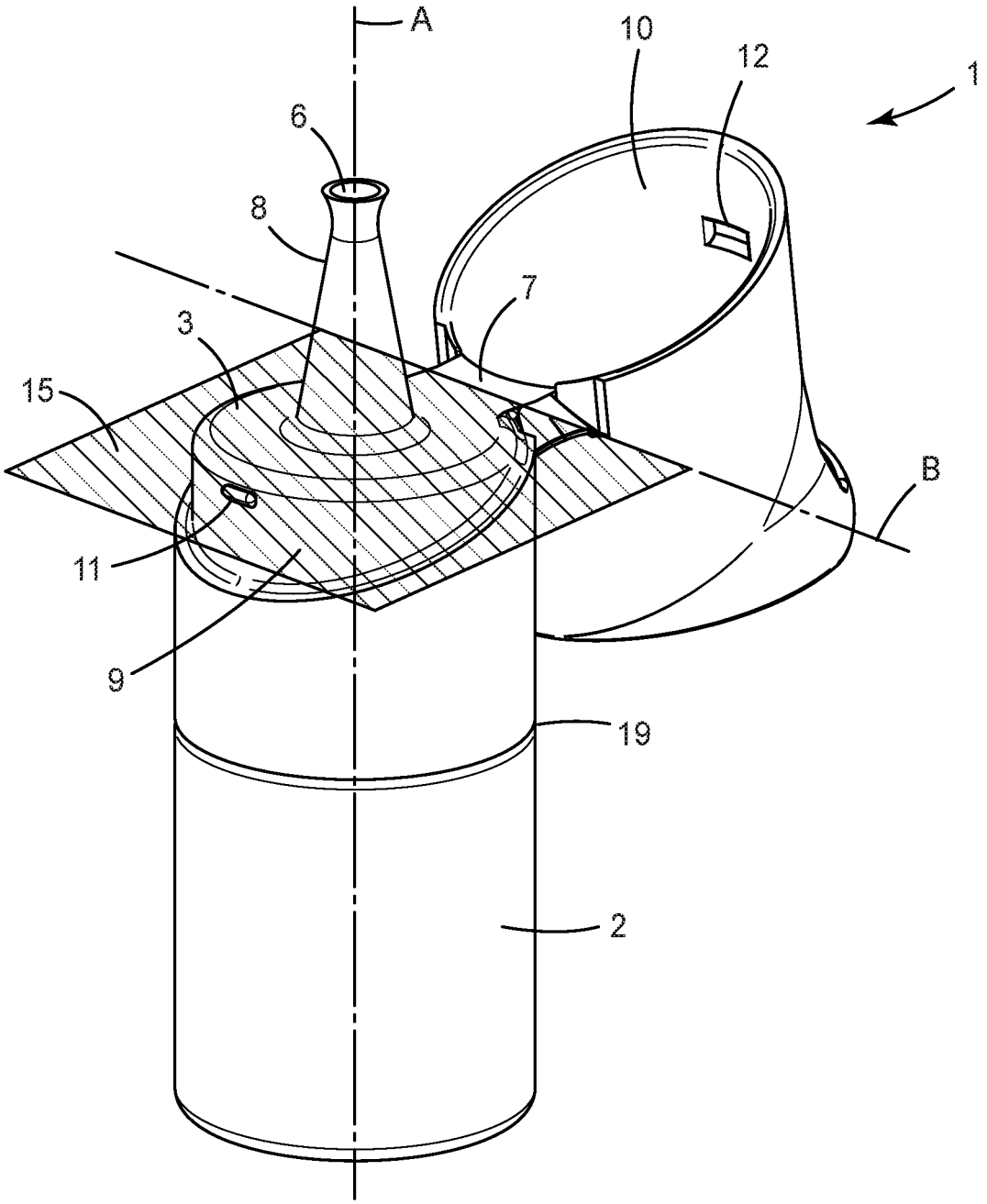
FIG. 2 is a perspective view of the dispenser of FIG. 1 in an open position.

FIGS. 1 and 2 show a dispenser 1 for a flowable substance. The dispenser 1 has a bottle 2 and a closure 3. The closure 3 has a base 4 and a flip-cap 5 that are interconnected by a hinge 7 so that the flip-cap 5 and the base 4 can be swiveled relative to each other between a closed position (shown in FIG. 1) and an open position (shown in FIG. 2). In the example, the flip-cap 5, the base 4 and the hinge 7 are injection-molded in one piece (monolithically formed). The hinge 7 particularly forms a living hinge. The living hinge provides for the swiveling based on a deformation of a thin band of plastic material (and not on two parts that move relative to each other by a sliding fitting). In the example, the hinge 7 further is a bistable hinge that urges the flip-cap 5 and the base 4 toward either of the closed or the open position, and prevents the flip-cap 5 and the base 4 from positioning in an intermediate position between the open and the closed position.

As shown in FIG. 2 the base 4 forms a dispensing outlet 6 for the flowable substance stored in the bottle. For dispensing the flowable substance the dispenser 1 is typically held with the outlet down (and the bottle up) so that the substance flows toward the base 4. The bottle 2, so held in place, can be (slightly) squeezed for dispensing the substance. The outlet 6 is formed by a dropper nose 8 (which is described in further detail below).

The base 4 has a shoulder 9 for sealing with the flip-cap 5. In particular, a side wall 10 formed by the flip-cap 5 and the shoulder are dimensioned to snugly and sealingly fit with one another in the closed position of the dispenser 1.

Further, the side wall 10 has a first retention structure 12 and the base 4 (in particular the shoulder 9) has a second retention structure 11. In the example the first retention structure 12 is a recess and the second retention structure 11 is a bulge. The first and second retention structure 11, 12 are positioned and configured such that they engage with each other in the closed position of the dispenser 1. Thus, the first and second retention structure 11, 12 retain the flip-cap 5 and the base 4 in the closed position by means of a snap-retention. The skilled person is aware that the first retention structure may likewise be a bulge or other positive structure and the second retention structure may be a recess or other negative structure. Other retention structures are possible.

The dispenser 1 extends along a longitudinal axis A. Further, the dispenser 1 has an overall cylindrical shape (as visible in FIG. 1) except for an actuator portion 14. The actuator portion 14 is shaped to allow a user to push the flip-cap 5 toward the open position, for example with a thumb. For pushing the flip-cap 5 toward the open position the user may place the dispenser 1 in one hand, holding the dispenser at the bottle 2 with the fingers of that hand and using the thumb of the same hand to push the flip-cap 5 toward the open position. Accordingly, the dispenser 1 enables a single-handed operation. The actuator portion 14 particularly forms a protrusion that protrudes in a dimension transverse to the longitudinal axis A. Further the actuator portion 14 forms an indentation 17. The indentation 17 helps positioning and retaining a user's thumb or finger at a desired position for reliably pushing the flip-cap 5 toward the open position.

The hinge 7 forms a swivel axis B that is arranged offset from the longitudinal axis A and oriented transverse, in particular perpendicular to the longitudinal axis A. The swivel axis B is defined within a virtual hinge-level plane 15 that is perpendicular to the longitudinal axis A. It is noted that the skilled person appreciates that the swivel axis B formed by the hinge may in some embodiments undergo a slight parallel or generally parallel displacement during swiveling. This shall however be covered by the present invention.

The closure 3 has a first end 18 and a second end 19. In the example the hinge-level plane 15 is arranged between the first end 18 and the second end 19. In an area between the hinge-level plane 15 and the second end 19 the closure forms an outer surface circumferentially around the longitudinal axis. This outer surface of the closure is at least partly provided by an outer surface of the base 4 and further is at least partly provided by an outer surface of the flip-cap 5. In the example, the outer surface of the closure 3 is cylindrical, composed of a partial cylindrical surface of the base 4 and a partial cylindrical surface of the flip-cap 5.

As indicated in FIG. 1 the flip-cap 5 and the base 4 in combination form a parting line 13. The parting line 13 is formed in an area in which the flip-cap 5 and the base 4 abut on each other. In the closed position of the dispenser shown in FIG. 1 the parting line 13 extends at least in part offset from the hinge-level plane. In particular, the parting line at the outer surface of the closure opposite of the hinge 7 is offset from the hinge-level plane toward the second end 19 of the closure.

Figure 3:
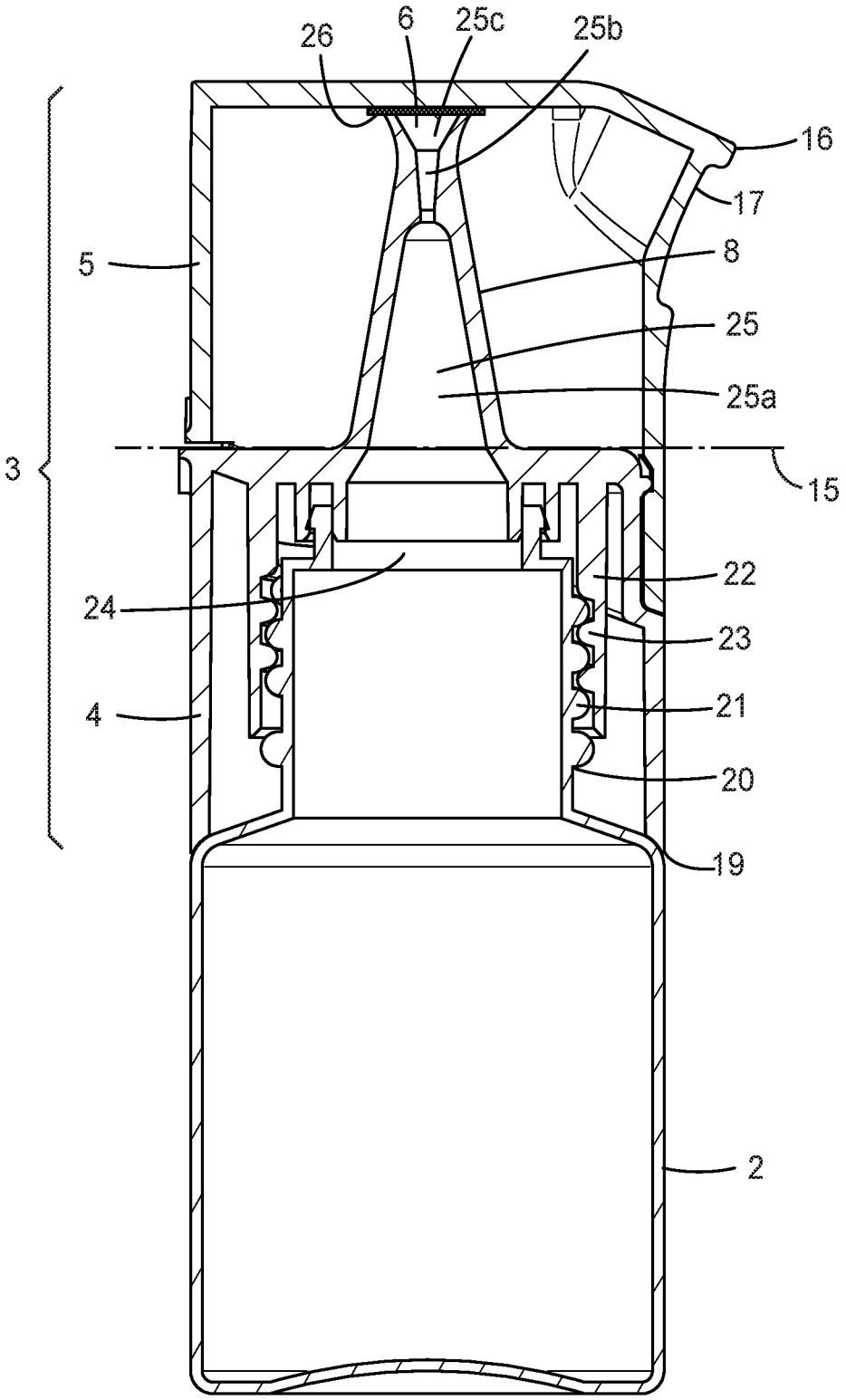
FIG. 3 is a cross-sectional view of the dispenser shown in FIGS. 1 and 2.

FIG. 3 shows the dispenser 1 in a cross-sectional view. The bottle 2 in the example has a neck 20 having an outer thread 21 which is mounted in a receptacle 22 of the base 4. The receptacle 22 has an inner thread 23 which is a corresponding counter thread of the outer thread 21 of the bottle 2. Although a thread connection between the bottle 2 and the closure 3 is preferred, the skilled person is aware of other connections that may likewise be used with the present invention. Other examples comprise a snap or plug connection, a welded connection an adhesive connection and other appropriate connections. In the example the dispenser 1 has a plug connection in combination with the thread connection. In particular, the bottle has a sealing rim that forms a free end of the bottle 2.

The bottle 2 has an opening 24 (which is the only opening of the bottle 2). The opening 24 of the bottle 2 is in fluid communication with an outlet channel 25 provided within the dropper nose 8. In the example the outlet channel 25 has a first portion 25*a*. The first portion 25*a* tapers from approximately the opening 24 of the bottle 2 in a direction toward the outlet 6. Further, the outlet channel 25 has a second portion 25*b* and a third portion 25*c*. The third portion 25*c* starts at the second portion 25*b* and widens toward the outlet 6. In particular, the third portion 25*c* forms an inner funnel-shaped surface that forms the outlet 6 at an end of the third portion 25*c*. The inner funnel-shaped surface in combination with the outlet 6 and the physical properties of the flowable substance provide for forming droplets of a reliably reproducible drop size during dispensing.

The dispenser 1 in FIG. 3 is shown in the closed position. In the closed position the flip-cap 5 closes the outlet 6. In particular, in the closed position the flip-cap 5 seals the outlet 6. Thus, the flowable substance is prevented from leaking out of the outlet 6. The flip-cap 5 therefore has a seal 26 which in the example is a flat elastic pad that is pressed on the end of the dropper nose 8 in the closed position. The flip-cap 5 can be swiveled to the open position (as shown in FIG. 2) so that the outlet 6 is open.

Figure 4:
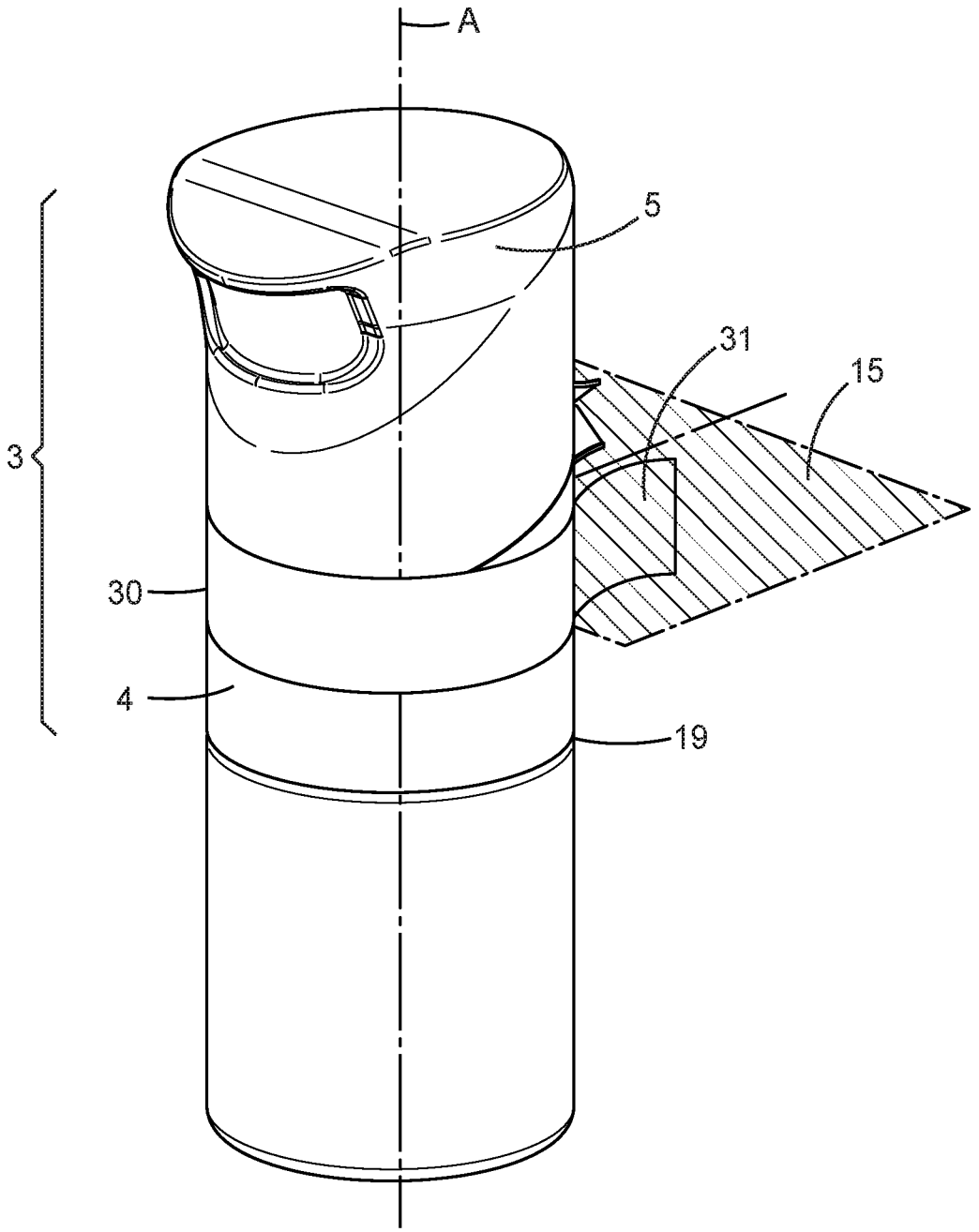
FIG. 4 is a perspective view of a dispenser according to an embodiment of the invention.

FIG. 4 shows the dispenser 1 with a first label 30 attached to it. In particular the first label 30 is wrapped around the outer surface of the closure in the area between the hinge-level plane 15 and the second end 19 of the closure 3. The first label 30 extends therefore circumferentially around the longitudinal axis A. Due to the fact that the outer surface of the closure in the area between the hinge-level plane 15 and the second end 19 of the closure 3 is provided by a portion of the outer surface of the base 4 as well as by a portion of the outer surface of the flip-cap 5, the first label 30 covers both, the portion of the outer surface of the base 4 and the portion of the outer surface of the flip cap 5. Therefore the first label 30 holds the flip-cap 5 and the base 4 in the closed position and retains the flip-cap 5 and the base 4 against swiveling toward the open position. The first label 30 in the example is further adhesive coated. Thus, the first label 30 is bonded to both, the portion of the outer surface of the base 4 and the portion of the outer surface of the flip cap 5. The holding and retention effect provided by the first label 30 against swiveling the flip-cap and the base toward the open position is therefore maximized.

The first label 30 further has a pull-strap 31. The pull-strap 31 in the example is not sticky. Therefore the pull-strap 31 may protrude away from the dispenser or may at least be easily detachable from the dispenser 1. The pull-strap 31 allows the first label to be grasped by a user who then can pull the first label away from the dispenser 1. The pull-strap 31 in the example further is configured as a tamper-evident label. This means that the first label after removal or partial removal cannot be reattached or rebonded.

Figure 5:
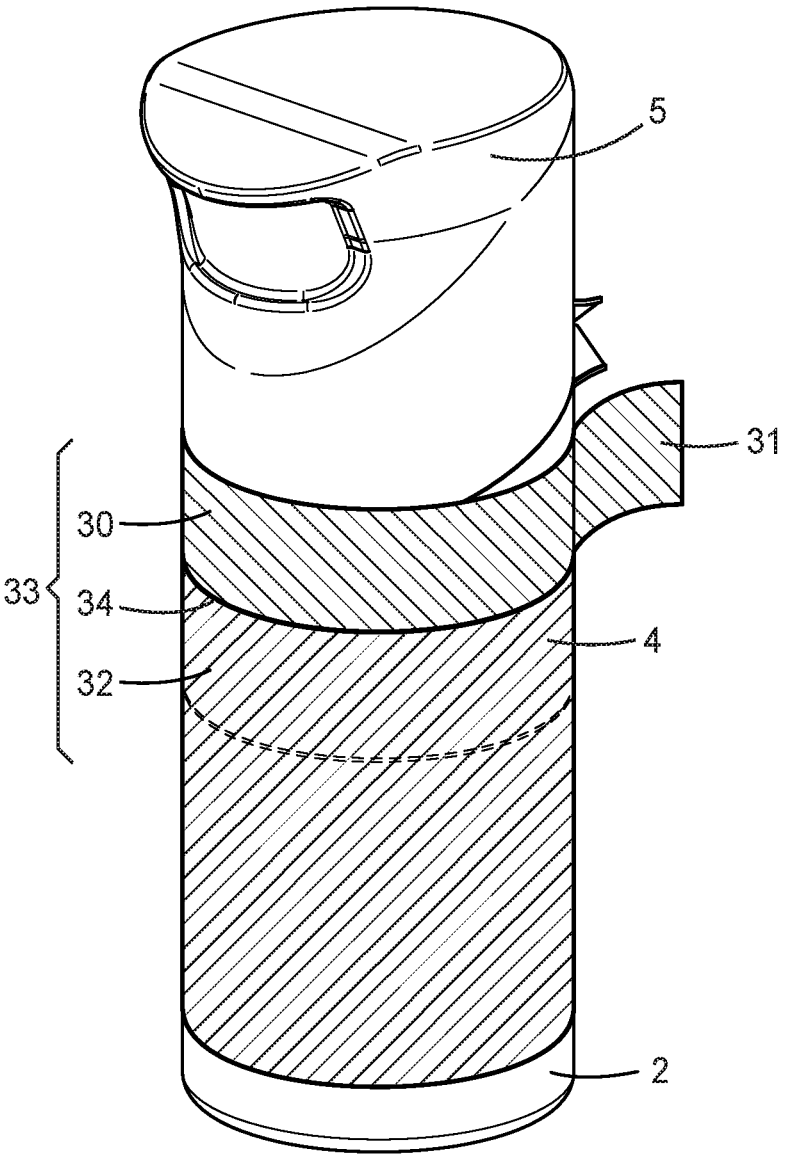
FIG. 5 is a perspective view of a dispenser according to a further embodiment of the invention.

FIG. 5 illustrates one example of a tamper tamper-evident label 33 which comprises the first label 31 and a second label 32. The first and second label 31, 32 in the example are interconnected via a pre-determined breaking zone 34. The first and second label 31, 32 may for example be part of one contiguous label and the pre-determined breaking zone 34 may be provided by a weakened (a partial cut through the label) line or a perforation arranged between the first and second label 31, 32. It is noted that in another example the first and second label may be separate (not interconnected). In that case the first label is provided with tamper evident properties. For example, a layer of the first layer may irreversibly split from another layer of the first label upon the first label is pulled off the dispenser 1. The second label 32 is sized to also extend over a part of the bottle. A third label (not shown) may be arranged on the dispenser 1, in particular on the bottle 2. The third label 35 may comprise a product identification and further information, like for example contents and expiration date.

The second label 32 in covers a portion of an outer surface of the base 4 as well as a portion of an outer surface of the bottle 2, but does not cover any surface portion of the flip-cap 5. The second label 32 is provided with an adhesive and bonded on the dispenser 1 by the adhesive. Thus, the second label 32 secures the bottle 2 and the base 4 (and thus the closure 3) from moving relative each other. In particular the second label 32 prevents the bottle 2 and the base 4 from being screwed off from each other. The second label 32 further is wrapped around the entire circumference of the dispenser (preferably with ends of the second label overlapping each other). Thus, any gap between the base 4 and the bottle 2 is closed or covered by the second label. This helps maximizing the hygiene in that undesired substances (like dirt and bacteria) are hindered from gathering in the gap.

What is claimed is:

1. A dispenser for a flowable substance extending along a longitudinal axis, the dispenser comprising:

a bottle and a closure for the bottle;

the closure comprising a base forming a dispensing outlet and a flip-cap for openably closing the dispensing outlet;

the base being attached on the bottle;

the dispenser further comprising a hinge which interconnects the flip-cap and the base for swiveling the flip-cap relative to the base between a closed position, in which the flip-cap closes the outlet, and an open position in which the outlet is open;

the hinge forming a swivel axis in a hinge-level plane that is arranged perpendicular to the longitudinal axis;

wherein the closure forms a first end in a direction toward the flip-cap and a second end in a direction toward the base;

wherein the closure in an area between the hinge-level plane and the second end forms an outer surface circumferentially around the longitudinal axis which is at least partly provided by an outer surface of the base and an outer surface of the flip-cap;

wherein in the closed position a first label is attached on said outer closure surface, with the first label covering at least a portion of the outer base surface and at least a portion of the outer flip-cap surface and thereby retaining the flip-cap against swiveling toward the open position;

wherein the flip-cap and the base in combination form a parting line in the closed position of the dispenser, and wherein the parting line extends at least in part offset from the hinge-level plane, and wherein the offset is in a direction from the hinge toward the second end of the closure, wherein the parting line is defined on a parting-level plane that is inclined with respect to the longitudinal axis; and wherein the hinge is configured to urge the flip-cap in either a pre-closed or an open position, wherein the pre-closed position is between the closed and the open position and closer to the closed position, and wherein in the pre-closed position the flip-cap and the remainder of the dispenser are visibly misaligned.

2. The dispenser of claim 1, wherein the flip-cap is formed by a cup-shaped shell having a bottom wall and a circumferential side wall extending from the bottom wall.

3. The dispenser of claim 2, wherein the hinge is connected to the side wall of the flip-cap.

4. The dispenser of claim 2, wherein a first retention structure is provided in or at the side wall for cooperation with a second retention structure provided on the base.

5. The dispenser of claim 1, wherein the first label extends at least partially circumferentially around the longitudinal axis.

6. The dispenser of claim 5, wherein the first label forms a pull-strap for facilitating the first label to be removed by a user.

7. The dispenser of claim 1, further comprising a second label bonded on the bottle.

8. The dispenser of claim 7, wherein the second label is additionally bonded to the base.

9. The dispenser of claim 8, wherein the first and second label are connected via a predetermined breaking zone allowing for the first label to be removed from the dispenser without removing the second label.

10. The dispenser of claim 1, wherein the closure between the hinge-level plane and the second end of the closure forms a cylindrical surface.

11. The dispenser of claim 1, comprising the flowable substance, wherein the flowable substance is a dental bonding dental material.

12. A dispenser for a flowable substance extending along a longitudinal axis, the dispenser comprising:

a bottle and a closure for the bottle;

the closure comprising a base forming a dispensing outlet and a flip-cap for openably closing the dispensing outlet;

the base being attached on the bottle;

the dispenser further comprising a hinge which interconnects the flip-cap and the base for swiveling the flip-cap relative to the base between a closed position, in which the flip-cap closes the outlet, and an open position in which the outlet is open;

the hinge forming a swivel axis in a hinge-level plane that is arranged perpendicular to the longitudinal axis;

wherein the closure forms a first end in a direction toward the flip-cap and a second end in a direction toward the base;

wherein the closure in an area between the hinge-level plane and the second end forms an outer surface circumferentially around the longitudinal axis which is at least partly provided by an outer surface of the base and an outer surface of the flip-cap;

wherein in the closed position a first label is attached on said outer closure surface, with the first label covering at least a portion of the outer base surface and at least a portion of the outer flip-cap surface and thereby retaining the flip-cap against swiveling toward the open position;

wherein the flip-cap and the base in combination form a parting line in the closed position of the dispenser, and wherein the parting line extends at least in part offset from the hinge-level plane, and wherein the offset is in a direction from the hinge toward the second end of the closure, wherein the parting line is defined on a parting-level plane that is inclined with respect to the longitudinal axis;

further comprising a second label bonded on the bottle, wherein the second label is additionally bonded to the base.

* * * * *